United States Patent [19]

Jacobi

[11] Patent Number: 4,579,509

[45] Date of Patent: Apr. 1, 1986

[54] DIFFUSER CONSTRUCTION FOR A CENTRIFUGAL COMPRESSOR

[75] Inventor: Helmuth O. Jacobi, Olean, N.Y.

[73] Assignee: Dresser Industries, Inc., Dallas, Tex.

[21] Appl. No.: 773,833

[22] Filed: Sep. 6, 1985

Related U.S. Application Data

[63] Continuation-in-part of Ser. No. 534,881, Sep. 22, 1983, abandoned.

[51] Int. Cl.[4] ..... F04D 29/44

[52] U.S. Cl. ..... 415/199.1; 415/219 A; 415/219 C

[58] Field of Search ..... 415/146, 198.1, 199.1, 415/199.2, 199.4, 199.6, 211, 219 A, 219 C, DIG. 1

[56] References Cited

U.S. PATENT DOCUMENTS

| | | | |
|---|---|---|---|
| 2,875,696 | 3/1959 | Von Zborowski | 415/148 |
| 3,105,632 | 10/1963 | Tanzberger | 415/199.1 X |
| 3,250,458 | 5/1966 | Caldwell | 415/199.2 X |
| 3,362,629 | 1/1968 | Papapanu | 415/DIG. 1 |
| 3,868,196 | 2/1975 | Lown | 415/146 |
| 3,930,746 | 1/1976 | Kronogard | 415/149 |
| 4,087,200 | 5/1978 | Korenblit et al. | 415/219 C X |
| 4,131,389 | 12/1978 | Perrone et al. | 415/211 |

FOREIGN PATENT DOCUMENTS

| | | | |
|---|---|---|---|
| 46173 | 2/1982 | European Pat. Off. | 415/219 A |
| 2436458 | 2/1975 | Fed. Rep. of Germany | 415/219 A |
| 937987 | 9/1963 | United Kingdom | 415/219 A |
| 222589 | 5/1970 | U.S.S.R. | 415/219 A |

*Primary Examiner*—Robert E. Garrett
*Assistant Examiner*—Joseph M. Pitko

[57] ABSTRACT

Constant flow width through the last stage diffuser of a centrifugal compressor is maintained against widening by the forces of differential pressure via a diffuser defined between oppositely positioned radial faces of a diaphragm and an annular diffuser plate secured spaced from the diaphragm at the desired width. Although slight movement occurs in the compressor components, the width of the diffuser flow passageway is not affected since its width is fixed and the diffuser plate is free to move because of the pressure balance provided by the annular cavity and vent holes extending through the plate.

4 Claims, 4 Drawing Figures

DIFFUSER CONSTRUCTION FOR A CENTRIFUGAL COMPRESSOR

This application is a continuation-in-part of application Ser. No. 534,881 filed Sept. 22, 1983 and now abandoned.

TECHNICAL FIELD

The field of art to which the invention pertains comprises the art of turbomachinery and component constructions therefor.

BACKGROUND OF THE INVENTION

Multistage centrifugal compressors are used for a variety of applications requiring high pressure, high volume throughput of a particular gas. To a large extent, such compressors are custom sized and manufactured to meet customer's specifications with tolerances and configurations being closely held on the various components in order to assure the design performance intended for the equipment. Such compressors are constructed from a plurality of parts forming the diffusers. The parts are positioned in end to end relationship forming the compressor.

Despite the accuracy of manufacture, a problem has been identified as associated with relatively small diffuser widths of such compressors in, for example, the last stage of a barrel-type straight through compressor or a back-to-back type compressor. Specifically, it has been found that in such compressors, the overall length of the multiplicity of parts sometimes rsults in at least one wall of the last diffuser stage tends to move slightly because of resultant stresses imposed by high operating pressures, causing width enlargement beyond the design dimensions. The resultant increase in diffuser flow width can typically amount to on the order of about 0.03 inches (0.76 cm) at differential pressures of 30 psig (207 KPa) in a compressor with a casing diameter of 60 inches (150 cm) or on the order of about 0.04 inches (0.102 cm) at differential pressures of 300 psig (2070 KPa) in a 24 inch (60 cm) casing diameter.

Such width changes in the diffuser are, of course undesirable in that it tends to alter the design performance of the compressor at the affected stage. Notwithstanding recognition of the problem, however, a solution therefor has not heretofore been known.

SUMMARY OF THE INVENTION

This invention relates to improvements in centrifugal compressors and more specifically to a construction in a centrifugal compressor able to substantially maintain a constant diffuser width under operating conditions at which uncontrolled increased widths have previously been encountered.

The foregoing is achieved in accordance with the invention by constructing one wall of the affected diffuser with an annular diffuser plate secured fastened in place thereat spaced from the diaphragm surface at the intended width. To avoid the adverse deflection effects of high pressure differentials imposed by the gas flow, the back face of the diffuser plate includes a radial extending recess which cooperates with the support wall thereat to define an annular cavity. A pressure balance between the front and back faces of the diffuser plate is achieved by a plurality of circumferentially spaced axial bores extending between the faces. Since the pressure balance effectively equalizes the pressure values exposed to both faces of the diffuser plate, the diaphragm surface can move as a result of the high pressures without changing the width of the diffuser flow passageway.

It is therefore an object of the invention to afford an improvement in centrifugal compressor construction able to maintain substantially constant diffuser width under operating conditions at which undesirable increases in diffuser widths have previously occurred.

It is a further object of the invention to effect the previous object with a relatively simple construction affording an economical solution to a long-standing problem.

Figure 1:
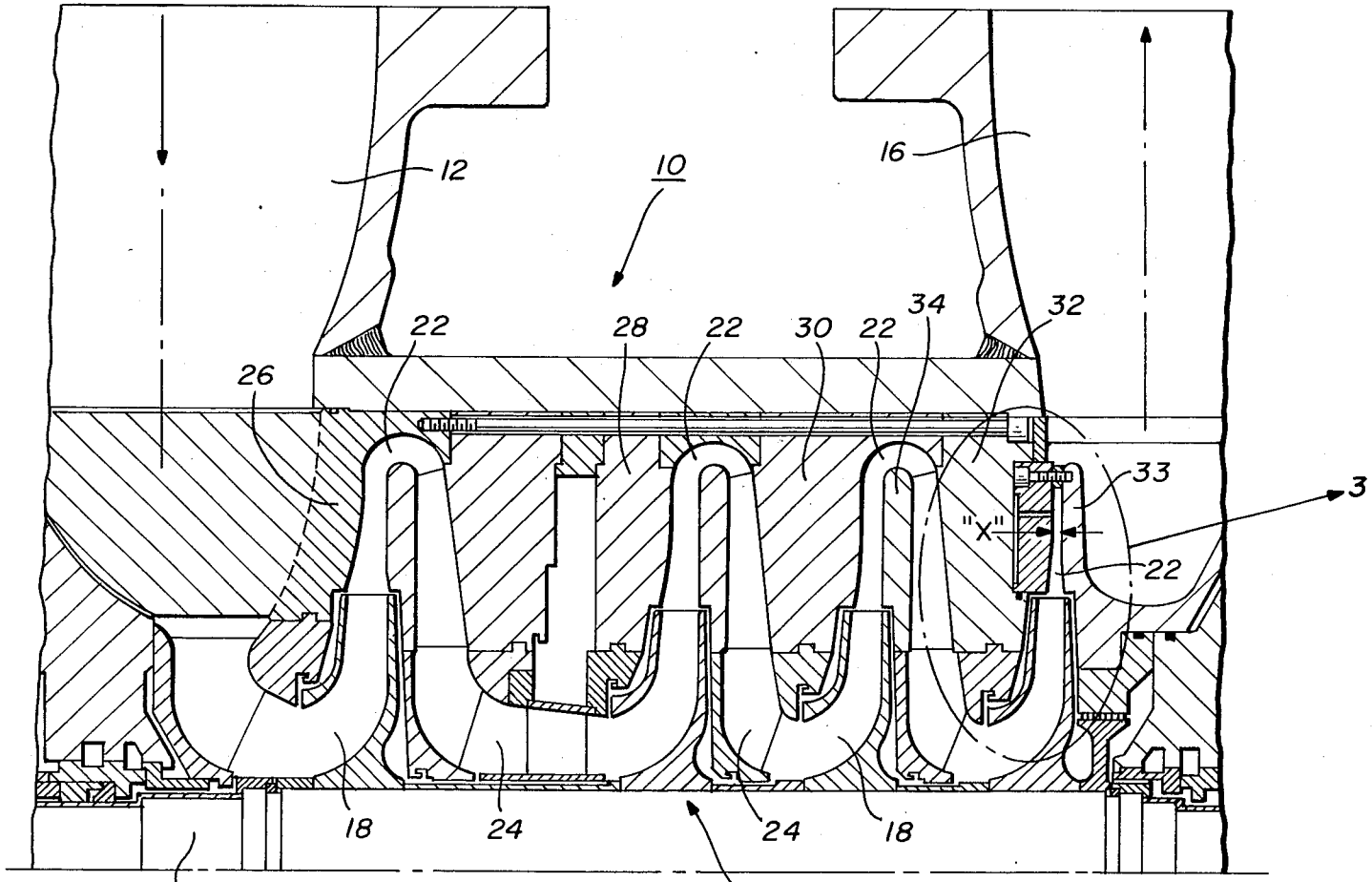
FIG. 1 is a longitudinal section through a straight through type centrifugal compressor embodying the invention hereof.

Referring now to the drawings, there is illustrated in FIG. 1 a multistage centrifugal compressor of a straight through type comprising a housing 10 defining a flow path extending from an inlet 12 in communication with a plurality of stages 14 leading to a discharge outlet 16. Comprising stages 14 are a plurality of axially spaced impellers 18 secured to a rotatable shaft 20. The stages are arranged in series flow communication with each other, and each impeller discharges a high velocity gas at its periphery. Energy transmitted to the gas creates a pressure rise as flow velocity decreases in the diffuser section 22 immediately downstream of the impeller. Form the diffuser, a stationary guide vane 24 directs the flow for proper entry into the next stage of succeeding impeller 18.

Between each impeller stage is a stationary diaphragm here designated 26, 28, 30 and 32 providing support for the stationary elements utilized between impellers such as the diffuser faces, guide vanes, return bend, labyrinths, etc. Associated with each diaphragm in the flow path entering the succeeding vane 24 is a flow clearance of predetermined width defined between the surface of the diaphragm and the bulb section 34 thereat. As can be noticed, the diffuser widths immediately downstream of the impeller at a common peripheral distance progressively decrese from the first relatively low pressure stage at diaphragm 26 to the final relatively high pressure stage at diaphragm 32. For purposes of explanation, the intended design width at diaphragm 32 is assumed to have a dimension X and for maintaining the dimension substantially constant, utilizes a construction 35 in accordance with the invention as will be described below.

Figure 2:
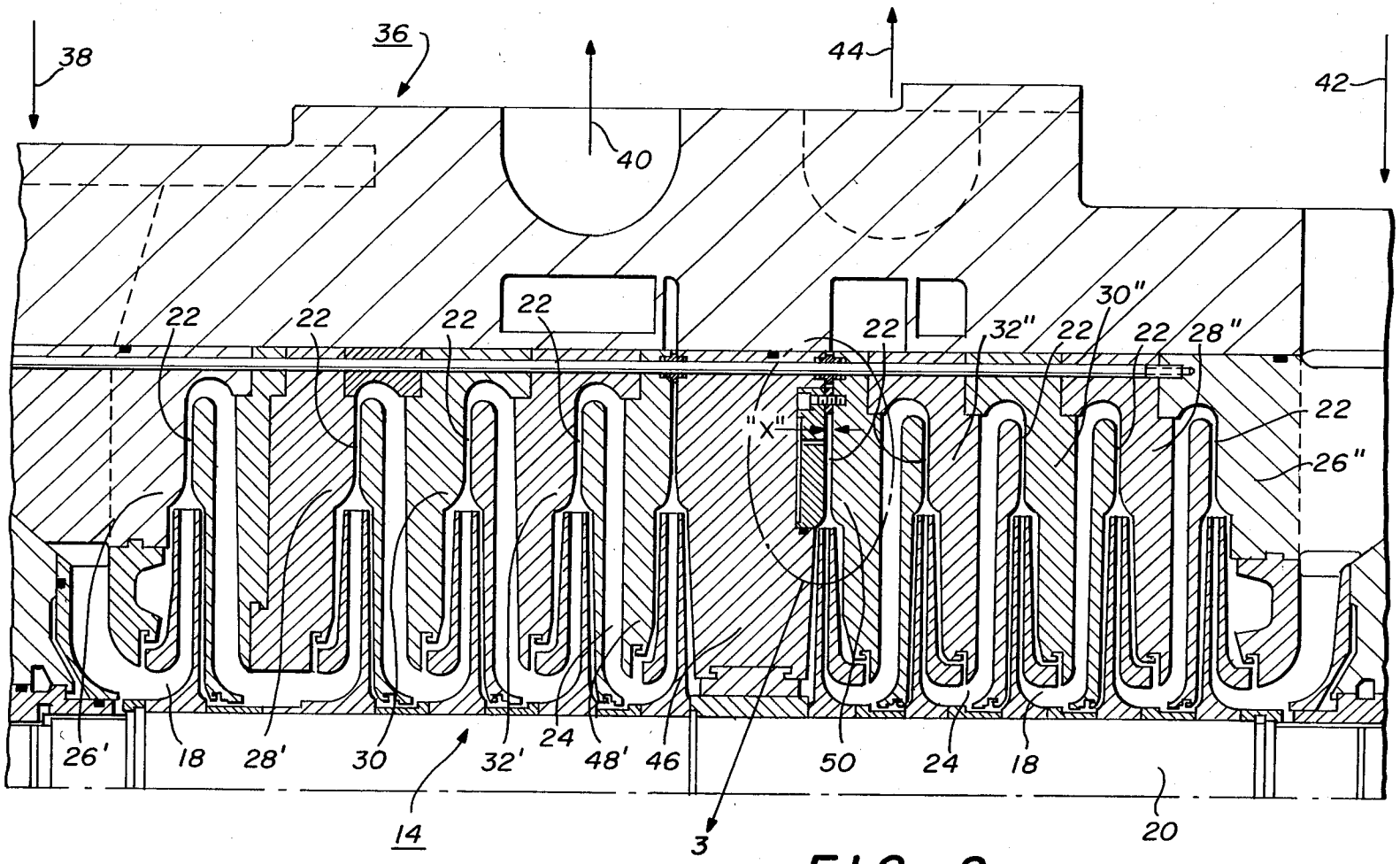
FIG. 2 is a longitudinal section through a back-to-back type centrifugal compressor embodying the invention hereof.

FIG. 2 is a comparable section to that of FIG. 1 for a back-to-back type compressor having a housing 36 that provides for a first section intake 38, a first section discharge 40, a second section intake 42 and a second section discharge 44 with the sections being separated by a division wall 46. Like in the construction of FIG. 1, each section includes a plurality of successive stages 14 comprised of spaced impellers 18 secured to a rotatable shaft 20. Series flow communication is provided between stages, and the impeller at each stage discharges a high velocity gas at its periphery. Between each impeller stage in each of the sections is a stationary diaphragm which for the first section are designated 26', 28', 30', 32' and 48', while for the second section are designated 26'', 28'', 30'', 32'' and 50'' for maintaining the width of their respective diffuser 22. Forming the diffuser between division wall 46 and diaphragm 50'' is the construction designated 35 in accordance with the invention as will be described.

Figure 3:
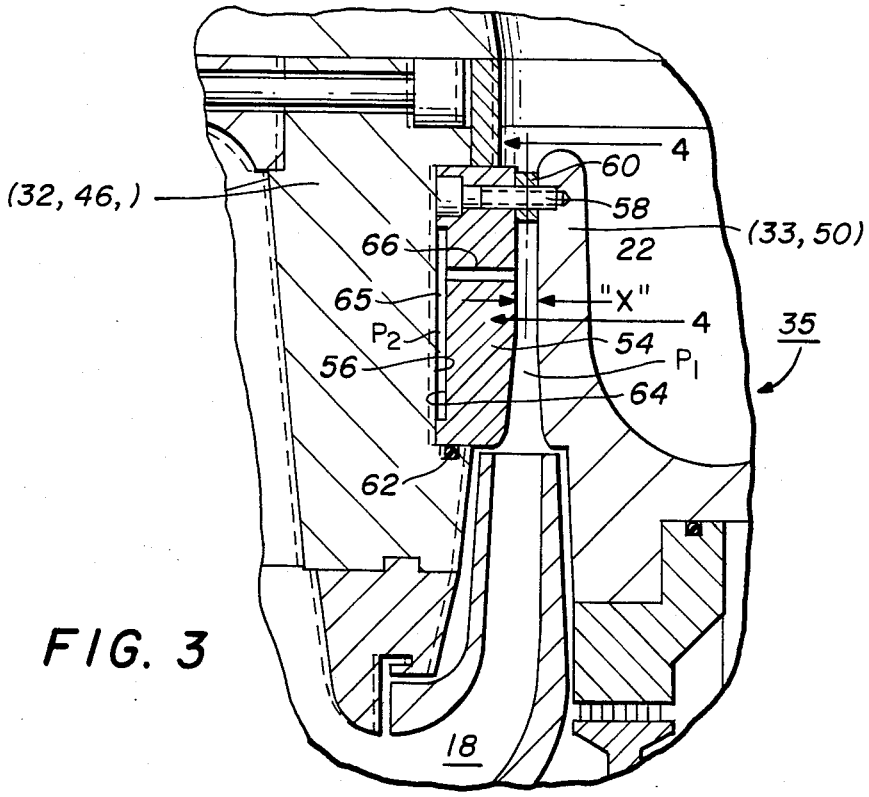
FIG. 3 is an enlarged sectional view of the encircled portions 3 of FIGS. 1 and 2.
Figure 4:
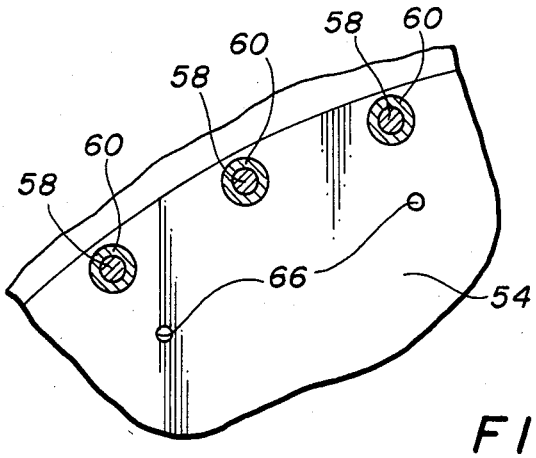
FIG. 4 is a fragmentary view as seen substantially along the lines 4—4 of FIG. 3.

Referring now to FIGS. 3 and 4, constant width X of diffuser 22 for the last stage in the embodiments of FIGS. 1 and 2 is maintained in accordance herewith by means of an annular diffuser plate 54 received in a closely sized annular recess 56 defined in diaphragm wall 32 or division wall 46. Opposite thereto for defining the diffuser is cooperating vane wall 33 and diaphragm wall 50, respectively. The diffuser plate 54 is secured accurately positioned via a plurality of circumferentially spaced bolts 58 to the opposite wall thereat through a sleeve bushing 60 of width dimension corresponding to diffuser dimension X sought to be maintained for the diffuser. An O-ring seal 62 maintains a pressure seal.

To render the diffuser plate 54 effective for the purposes hereof, its rear face includes an annular radially extending recess 64 which in cooperation with recess wall 56 defines an annular cavity 65. By means of a plurality of axially through vent holes 66, radially located to produce a means pressure balance, pressure $P_1$ in diffuser 22 is continuously communicated with cavity 65 such that pressure value $P_2$ in the latter is the same as or closely approaching the pressure value $P_1$ on the former. By this arrangement, therefore, a pressure balance between the front and rear faces of the diffuser plate is substantially maintained thereby precluding undesirable effects of movement of the compressor parts as a result of high pressure as has occurred to increase diffuser width in the manner of the prior art.

The dash line shown in FIG. 3 illustrates the exaggerated position of the division wall 46 when high pressure is in the diffuser passageway. It should be noted that although the wall 46 has moved, the plate 54 remains in its initial position maintaining the flow passageway width "X" constant.

By the above description there is disclosed a novel improvement for a centrifugal compressor affording a substantially constant diffuser width under conditions similar to which conventional diffusers of the prior art have encountered undesirable increases in the width dimension. By maintaining the diffuser width constant in the manner hereof, performance of the affected stage is able to conform with design specifications without loss attributed to uncontrolled width increases as has previously occurred. At the same time, the construction of the invention is relatively simple and economical to implement for achieving the sought after result of enhanced compressor performance.

Since many changes could be made in the above construction, and many apparently widely different embodiments of this invention could be made without departing from the scope thereof, it is intended that all matter contained in the drawings and specification shall be interpreted as illustrative and not in a limiting sense.

The embodiments of the invention in which an exclusive property or privilege is claimed are defined as follows:

1. An improved multistage centrifugal compressor, said compressor including a diffuser having first and second portions defining a fluid flow path therein located radially outwardly of each impeller, the improvement comprising:

an annular recess located in the first portion of said diffuser adjacent to the flow path defined thereby;

an annular plate moveably located in said recess, said plate having a front surface defining a portion of the diffuser flow path, a rear surface located in said recess, and a plurality of spaced vent holes extending through said front and rear surfaces whereby the pressure in said recess is approximately equal to the pressure in said flow path;

a plurality of spacing members located in said flow path in engagement with the front surface of said plate and with said second portion of said diffuser; and, fastener means connecting said annular plate and spacer members to the second portion of said diffuser across said flow path whereby said annular plate is retained in fixed relationship to said second portion to define the width of said flow path, said plate, spacing members and fastener means being moveable relative to the first portion.

2. The multistage centrifugal compressor according to claim 1 wherein said spacing members comprise a plurality of circumferentially spaced members located in said diffuser flow path in engagement with said front surface to establish the design width thereof.

3. The multistage centrifugal compressor according to claim 2 wherein said fastener means comprises a plurality of bolts and each of said spacing members comprises a tubular sleeve through which one of said bolts extends.

4. The multistage centrifugal compressor of claim 3 wherein said annular plate has an annular groove in the rear surfaces thereof adjacent to said first portion of said diffuser, said vent holes extending into said annular groove.

* * * * *